US005806097A

United States Patent [19]

Grilliot et al.

[11] Patent Number: 5,806,097

[45] Date of Patent: Sep. 15, 1998

[54] PROTECTIVE GARMENT PROVIDING PROTECTION AGAINST BLOOD BORNE PATHOGENS

[76] Inventors: William L. Grilliot; Mary I. Grilliot, both of P.O. Box 14616, Dayton, Ohio 45413

[21] Appl. No.: 581,453

[22] Filed: Dec. 29, 1995

[51] Int. Cl.[6] ..... A41D 13/00

[52] U.S. Cl. ..... 2/81; 2/82; 2/87; 2/97; 2/457

[58] Field of Search ..... 2/81, 82, 85, 87, 2/93, 97, 458, 457, 79

[56] References Cited

U.S. PATENT DOCUMENTS 5,014,357 5/1991 Wiseman, Sr. ..... 2/81

*Primary Examiner*—Diana Biefeld

*Attorney, Agent, or Firm*—Rockey, Milnamow & Katz, Ltd.

[57] ABSTRACT

A protective garment, and preferably a protective garment for firefighters, utilizing two strips of moisture impermeable, wick resistant material adjacent one or more openings of the garment in which the wick resistant materials form a shingle effect to prevent transmission of toxic liquids through seams of the garment for contamination of the wearer.

27 Claims, 3 Drawing Sheets

FIG. 1
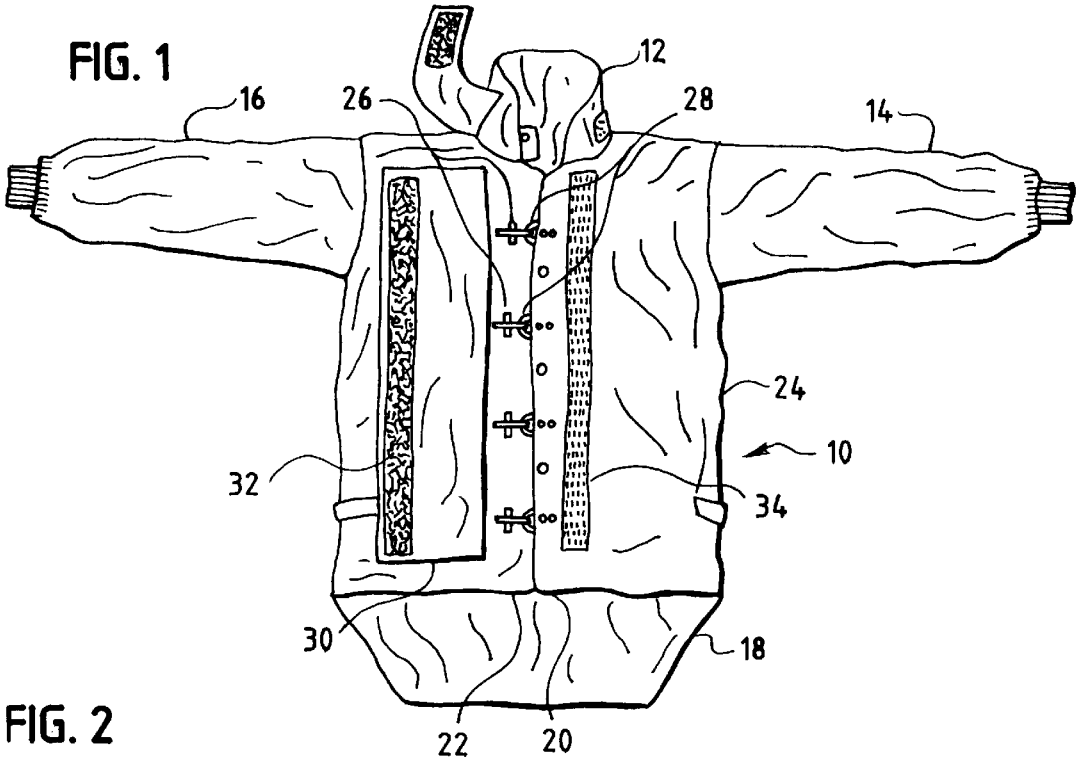
FIG. 2
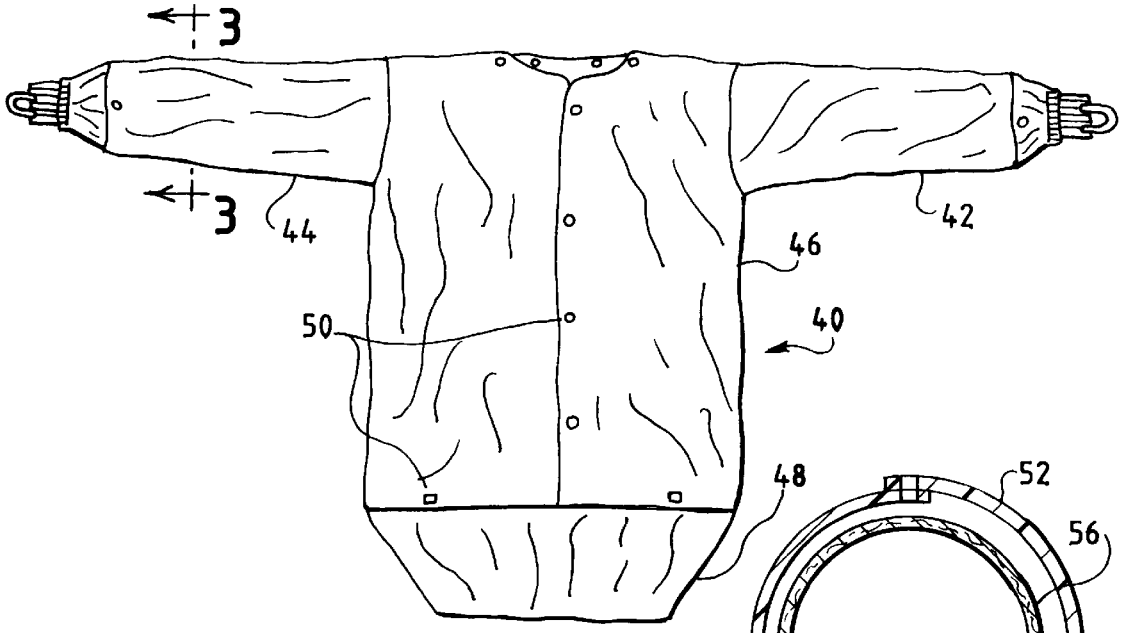
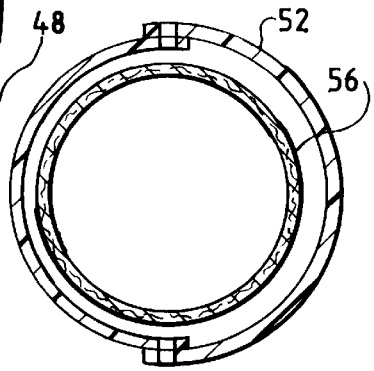
FIG. 3

PROTECTIVE GARMENT PROVIDING PROTECTION AGAINST BLOOD BORNE PATHOGENS

BACKGROUND OF THE INVENTION

This invention relates to protective garments providing improved protection against toxic liquids, and more particularly a firefighter garment providing protection against blood borne pathogens.

Firefighters, and particularly protective coats for firefighters have typically included three layers, namely an outer shell formed of a flame resistant, heat resistant, moisture resistant and abrasion resistant layer of fabric underlying a moisture barrier having not only resistance to moisture but also thermal resistance as well. The inner layer of the typical firefighter protective coat is often referred to in the prior art as a thermal barrier; it provides thermal protection to the firefighter against high temperatures approaching 1000° F. to which a firefighter may be subjected. Such typical firefighter garments are disclosed, for example, in U.S. Pat. No. 5,001,781, the disclosure of which is incorporated herein by reference.

The typical firefighter coat has an opening in the front which may be closed by means of a series of hooks spaced vertically in the center of the coat. It is some times desirable to provide a flap covering the front of the coat, and specifically covering the hooks securing the front portions of the coat together; that flap can be conveniently closed by means of a Velcro® closure.

As is recognized by those skilled in the art, the various layers making up a conventional firefighters coat can be varied. Under some conditions, it is desirable to attach two of the layers to each other. For example, it is conventional to employ a firefighter protective coat in which the moisture barrier and the thermal barrier are attached each to the other, and are removably positioned within the outer shell.

As will be appreciated by those skilled in the art, firefighters often find themselves in situations in which they must respond quickly in emergency calls, donning their protective clothing. It is, therefore, an important feature of a firefighter protective coat that it have a wide front opening permitting rapid donning in emergency situations. Because of that consideration, it is virtually impossible to construct a firefighter protective coat which is quick to don and which provides an essentially liquid-tight seal. Liquid-tight seals become increasingly important in the protection of firefighters working in emergency situations. It is a common occurrence that a firefighter responds to emergency situations such as automobile accidents and airplane crashes in which blood may be found at the scene of the emergency. Indeed, up to about 80% of all field emergency medical responses are provided by fire service personnel. Thus, firefighters are often exposed to emergency situations in which the blood present at the scene may contain blood borne pathogens, namely infectious diseases transmitted by blood to blood contact. The two primary pathogens with which firefighters are concerned are viruses such as the Hepatitis B virus and the HIV virus. Indeed, recent surveys conducted by the International Association of Firefighters indicated that one out of every 16 firefighters may be exposed to communicable diseases carried by the blood of accident victims. Such surveys have indicated that firefighters exposed to communicable diseases may range as high as 8% for Hepatitis B and 20% for HIV.

As a result, the Occupation Safety Health Association (OSHA) has recently promulgated a standard by which firefighters should be protected from such blood borne pathogens such as Hepatitis B and HIV. However, technology has only recently permitted the use of moisture barrier materials which have the capability of meeting not only the requirements for safety in structural fires but also protection against blood borne pathogens. Standards have now been set by the National Fire Protection Association for resistance to viral penetration on the part of moisture barriers.

Thus, while most moisture barriers commercially available which are suitable for use in protective garments for firefighters now satisfy the NFPA standards for resistance to viral penetration, blood borne pathogens nonetheless continue to represent a hazard to firefighters. The principal reason for the continued existence of the hazard is the virtual impossibility of providing liquid-tight seals in the seams and closure of firefighter garments which completely protect a firefighter from blood at the scene of an accident and the viruses which may be contained in such blood. One of the problems which has been found to exist is the problem of wicking. Wicking is a phenomenon by which a liquid, such as blood, advances from the outer shell of a firefighter protective garment through the garment by means of capillary action. For example, the closure seams in the front of a firefighters coat may allow wicking of blood borne pathogens whereby the blood advances through the outer shell material to the thermal barrier from which it can come into contact with the firefighter. Because there is always the risk that the wicking of such blood may expose the firefighter to blood borne pathogens, it has become increasingly important to prevent or substantially minimize wicking in a protective garment for a firefighter.

It is accordingly an object of the present invention to provide a protective garment, and particularly a firefighter protective garment, which overcomes the forgoing disadvantages.

It is a more specific object of the invention to provide a protective garment for firefighters in which the firefighter is protected from blood borne pathogens. It is a more specific object of the invention to provide a firefighter garment in which wicking of toxic liquids, including liquid carrying blood borne pathogens, is substantially avoided.

These and other objects and advantages of the invention will appear more fully hereinafter by reference to the following description and drawings.

SUMMARY OF THE INVENTION

The concepts of the present invention reside in a firefighter protective garment not only provides thermal protection for the firefighter but also protection from toxic liquids such as blood containing pathogens. In accordance with the concepts of the invention, the protective garment of this invention includes the conventional three layers, or a material performing the function of the conventional three layers of an outer shell, a moisture barrier, and a thermal barrier but which includes, adjacent to one or more openings of the garment, a facing and a moisture-resistant and wick-resistant strip covered by the facing. Positioned beneath the facing but between the outer shell material and the facing is positioned at least one further strip of moisture impermeable, wicking resistant material which may be folded over the facing to overlay at least a portion of that facing in the area of the seams of the coat to provide a continuous layer of moisture impermeable, wick resistant fabric to prevent or at least substantially minimize wicking of toxic liquids through the seams of the garment.

It has been found that the use of such a strip, which most generally has a V-shaped configuration, prevents or substantially minimizes wicking through the seams of the garment, thereby protecting the thermal liner from adsorbing such toxic liquids. That, in turn, prevents such toxic liquids from coming into contact with the body of the firefighter. Thus the combination of those layers of moisture impermeable, wick resistant materials in the area of seams adjacent to the closure of the coat establishes a maze configuration through which such liquids would have to pass to reach the interior of the garment to contaminate the firefighter. It has been found that the maze thus established prevents or substantially minimizes the ability of such toxic liquids to pass by capillary action through areas of the coat adjacent the closure thereof through seams to contaminate the inner liner.

The concepts of the present invention find particular utility in a firefighter's coat. Such a coat includes an outer shell to enclose at least a portion of the torso of a firefighter formed usually of a flame resistant, moisture resistant and abrasion resistant fabric. Facings in such a garment are positioned in a strip along the front of the coat adjacent to the leading edges thereof which are joined together when the garment is closed by the firefighter. The facings have positioned beneath them and between the facing and the outer shell strips of a moisture impermeable, wicking resistant material which may extend from the reverse side of the facing over the edge thereof so that the moisture impermeable, wicking resistant material not only underlays the facing but also overlays at least a portion of the reverse side of the facing to provide a substantially continuous liquid resistant barrier layer. It has been found that such a construction prevents the wicking of toxic liquids, including blood containing pathogenic organisms, from wicking through the seams or hems of the coat, and particularly the stitching thereof, thus preventing such liquids from passing by capillary action through the seams or hems to the inner-most liner from which they can come into contact with the body of the firefighter.

Thus the protective coat embodying the features of this invention not only provides thermal protection to a firefighter in the environment in which he works. So too, the concepts of the present invention provide improved resistance to the wicking of toxic liquids, including blood containing pathogens therein.

While the present invention is particularly well suited for use with protective garments for firefighters, it will be understood by those skilled in the art that the same features of the invention may likewise be employed in protective garments worn by emergency providers such as paramedics and the like. Generally, such garments can have a similar construction of an outer shell and a moisture barrier as described with reference to a firefighter's garment. However, garments typically worn by such emergency providers generally do not employ a thermal barrier since there is typically no need to protect emergency providers from the affects of extreme heat as is the case with a firefighter.

In another embodiment of the invention, the concepts of the present invention may likewise be used in the collar area of the coat in which a facing strip is mounted in the collar area for removable attachment of the corresponding portions of the moisture barrier and thermal barrier. Such a collar facing may be formed of any heat resistant fabric and has a moisture resistant, wicking resistant strip to prevent or substantially minimize wicking of such toxic liquids through the seams or hems at the collar, keeping such liquids from the body of the firefighter.

While the concepts of the present invention are applicable primarily to firefighters'coats, it will be appreciated by those skilled in the art that the concepts of the invention are likewise suitable for use in trousers worn by firefighters as well. The concepts of the present invention may be applied to, for example, facings in the waist area of a firefighter's protective trousers as well as in the lower leg area where the firefighter is likely to encounter such toxic liquids.

DESCRIPTION OF THE DRAWINGS

FIG. 1 is a view and elevation of the front of a firefighter's garment, illustrating the outer shell portion of a firefighter's coat.

FIG. 2 is a corresponding view of the thermal barrier and moisture barrier used with the outer shell illustrated in FIG. 1.

FIG. 3 is a sectional view taken along the lines of FIG. 1.

DETAILED DESCRIPTION OF THE INVENTION

Figure 4:
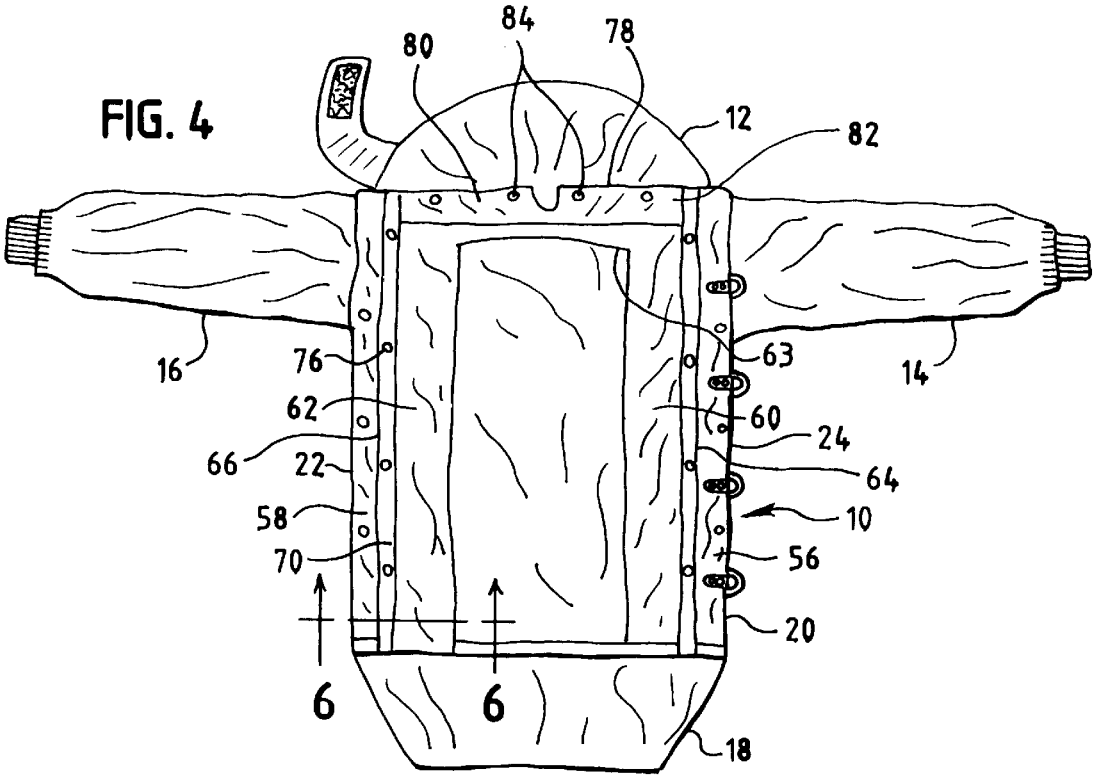
FIG. 4 is a view and elevation showing the inside of the outer shell illustrated in FIG. 1.

The concepts of the invention may be illustrated by the drawings herein illustrating the application of the invention to a firefighter protective coat.

The outer shell and its configuration are illustrated in FIG. 1 of the drawing. The outer shell includes a collar 12, arms 14 and 16, respectively and, in the preferred embodiment, a tail portion 18 projecting from the back portion of the outer shell. The coat 10 includes a pair of plackets 20 and 22 which are integral with the torso portion 24 of the coat and form the opening of the coat. As is illustrated in FIG. 1, one placket 22 is provided with a plurality of fastening means 26, illustrated in the drawing as a plurality of releasable hooks which are themselves well known to those skilled in the art. The hooks are mounted in alignment with a plurality of D-rings or eyelets 28 and releasably engage with the D-rings or eyelets 28 to maintain the garment in a closed position.

It is sometimes desirable to employ a covering for the plackets 20 and 22 such as a flap 30 having a fastening means such as a strip of hook or loop fastener sold under the trademark Velcro® 32. The hooks 26 and eyelets 28 can thus be protected by the environment in which the firefighter works by means of the flap 30 which can be folded over the hook 26 and eyelet 28 so that the hook or loop fastener sold under the trademark Velcro® 32 is applied with a corresponding hook or loop fastener sold under the trademark Velcro® 34 on the opposite placket. Alternatively, one of the hooks 26 or D-rings 28 can be mounted on the flap and the other mounted on the outer shell so that the flap may be closed and locked in position by engaging the hooks 26 with the D-rings 28 mounted on the exterior of the flap and the outer shell.

The outer shell, as indicated above, is formed of a flame and heat resistant, moisture resistant and abrasion resistant material, and preferably a fabric. Fabric for use in forming the outer shell of firefighter garments are well known to those skilled in the art. Suitable materials include Nomex fabric, Kevlar fabrics, PBI fabrics and the like. In FIG. 2, there is shown one example of an inner liner which may be employed in the practice of the invention. The inner liner 40 includes corresponding portions including arm portions 42 and 44 respectively along with a torso portion 46 which may or may not be provided with a tail 48. As will be appreciated by those skilled in the art, the inner liner 40 is dimensioned to correspond to and fit within the outer shell 10. It is typically secured to the outer shell by means of fastening means, such as snaps 50 as illustrated in FIG. 2. In the preferred embodiment of the invention, the inner liner is formed of a moisture barrier 52 and a thermal liner 54 as illustrated in FIG. 3 of the drawing. Depending somewhat on the application, the thermal barrier and the moisture barrier may be connected one to the other in all or parts of the garment. In the usual case, the thermal liner is sewn to the moisture barrier about the periphery of the torso portion. As illustrated in FIG. 3, however, the thermal liner 54 simply fits within the moisture barrier 52 in the area of the sleeves and may or may not be fixedly attached thereto.

Once again, the materials used in forming the moisture barrier and the thermal liner are well known to those skilled in the art. As the moisture barrier, use can be made of fluid impermeable materials such as neoprene and neoprene coated fabric, GoreTex, Breathtex and like fabrics. The fabric GoreTex is preferred because it has the ability to selectively pass vapors through the moisture barrier while repelling liquids. That is frequently useful to a firefighter in allowing perspiration generated by the firefighter to be diffused through the moisture barrier as an aid to the comfort and minimum stress to which the firefighter is subjected. Similarly, thermal liners are well known to those skilled in the art and generally include one or more layers of heat resistant insulative fabrics such as Aralite fabrics, Nomex fabrics and the like. Such fabrics are known to possess good thermal protective performance, and thus serve to protect the firefighter against high temperature which the firefighter might encounter in the course of his work.

The interior of the outer shell including the features of the present invention are illustrated in FIG. 4 of the drawing. FIG. 4 illustrates the outer garment which has been opened to expose the internal portions of the outer shell within the coat. Each of the plackets 20 and 22 are illustrated and include a facing 56 and 58 respectively, in the form of strips of fabric positioned on the interior of the outer shell in a strip along the plackets 20 and 22. Underlying, in the preferred embodiment of the invention, the facings 56 and 58 are strips 60 and 62 of a moisture resistant material, such as the material used in forming the moisture barrier. The strip 60 and 62 are stitched along their periphery to the outer shell fabric and the facing fabric along the leading edges of the plackets 20 and 22. In one embodiment, as illustrated in FIG. 4 of the drawing, the strips 60 and 62 may be integral with a corresponding strip extending between them shown as 63 in the drawing positioned in the vicinity of the neck region of the coat. In that embodiment, the strips 60 and 62 may simply be a single U-shaped configuration sewn to the outer shell 10 of the torso portion 24 of the coat. Alternatively, strips 60, 62 and 63 may be formed of three separate pieces of wick-resistant material.

Figure 6:
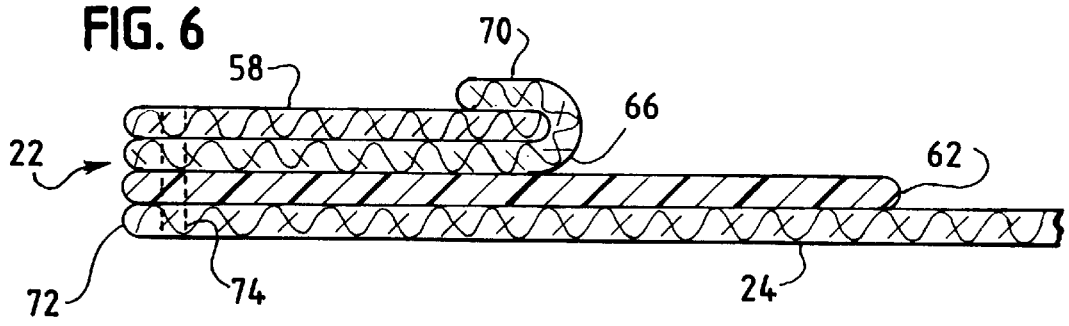
FIG. 6 is a cross sectional view taken along the lines 6—6 in FIG. 4 illustrating the cross section of the garment of this invention.

The wicking resistant material is present in the coat in a pair of strips 64 and 66 as illustrated in FIG. 4 of the drawing. For a more detailed description of this portion of the coat, reference is made to FIG. 6 of the drawing, a sectional view taken along the lines 6—6 in FIG. 4. As can be seen from that figure, the fabric forming the facing 58 overlays the anti-wicking material 66. However, the anti-wicking material may, in one preferred embodiment, include a folded over portion 70 which overlays a portion of the facing 58 but otherwise extends to the edge 72 where all the layers are stitched together by means of convention stitching 74. As will be appreciated by those skilled in the art, it is also possible, as an alternative, to configure the facing 58 in such a way that a portion of facing 58 is formed of the anti-wicking material as by stitching the facing fabric, which can be any of a variety of fabrics (e.g., thermal liner, moisture barrier, outer shell or combinations thereof), to the fabric making up the facing. Alternatively, it is possible, and sometimes desirable, to form the entire facing 58 from a moisture impermeable, anti-wicking material. In that embodiment, the facing 58 is formed of a single material, namely a moisture impermeable, wick resistant fabric.

Underlaying the anti-wicking material 66 is the strip 62 of a moisture resistant material; the final layer is the torso portion 24 of the outer shell material. As can be seen from FIG. 6, all four of the layers are stitched together at the edge of the placket 22. Because the wicking resistant layer 66 is positioned on the outside of the facing 58 and toward the remainder of the coat, any toxic liquids which might diffuse through the outer shell 24 and moisture barrier strip 62 are prevented from wicking past the facing 58 to the remainder of the coat by means of the wicking resistant material 66. That in turn prevents any such liquids, including a blood containing pathogenic organisms, from being transported by means of capillary action beyond the anti-wicking layer 66.

Spaced along the folded over portion 70 of the wick resistant layer 66 are a-plurality of fastening means 76. Those fastening means 76 are preferably in the form of conventional snaps which are used to, as will be discussed hereinafter, attach the inner liner to the outer shell to ensure that the firefighter is protected by means of the moisture barrier and the thermal liner. As will be appreciated by those skilled in the art, a variety of other fastening means apart from snaps may likewise be used, including hook or loop fastener sold under the trademark Velcro®, hooks and D-rings and the like mechanical fastening elements conventionally used in firefighters' garments.

In one embodiment of the invention, the coat may include a flap 80 at the upper portion of the torso portion 10 of the outer shell which is stitched to the outer shell along the collar line 78. If desired, that flap 80 may likewise be provided with an outer covering 82 of wick resistant material, on both sides of the flap 80. That flap 80 may likewise be provided with an outer covering 82 of wick resistant material on both sides of the flap 80. That in turn ensures that any liquids collecting at the collar area of the coat will not be transported by wicking or capillary action to the skin of the firefighters and thus provide additional protection against wicking in the collar area. The flap 80 having the conventional anti-wicking material 82 is also provided with a plurality of fastening means such as snaps 84 which permit the area of the inner liner corresponding to the collar to be snapped to the flap 80 when the inner liner is placed within the outer shell.

Figure 5:
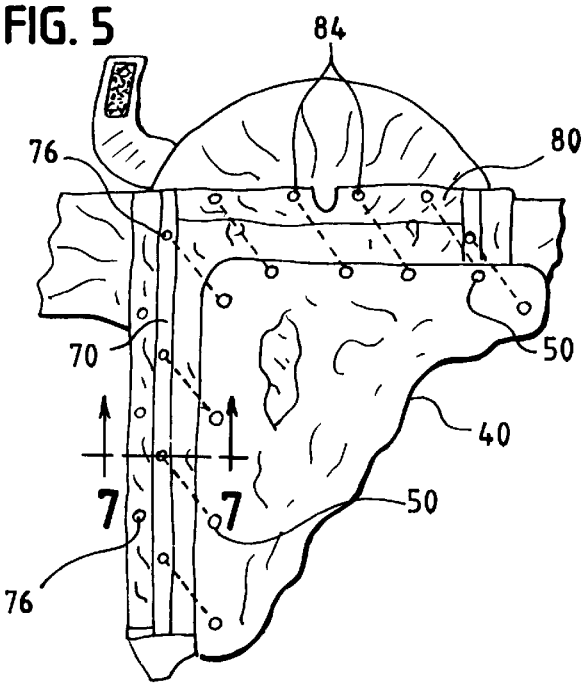
FIG. 5 is a view illustrating the attachment of the thermal liner and moisture barrier layers to the outer sheller illustrated in FIG. 4.

As is perhaps best illustrated in FIG. 5 of the drawing, the inner liner 40 can thus be fixed to the outer shell 10 by engaging the snaps 76 on the anti-wicking layer 66 and the snaps 84 on the collar flap 80 with corresponding snaps 50 positioned about the periphery of the inner liner 40. In that way, the inner liner may be secured along the anti-wicking strips 64, 66 and 82 to ensure continuous protection of the firefighter against moisture and heat while at the same time the anti-wicking strips 70 and 80 prevent wicking of any liquids from the exterior of the coat to the inner liner 40 where they might come into contact with the firefighter. That, of course, ensures protection of the firefighter against toxic liquids, including blood containing pathogenic organisms.

Figure 7:
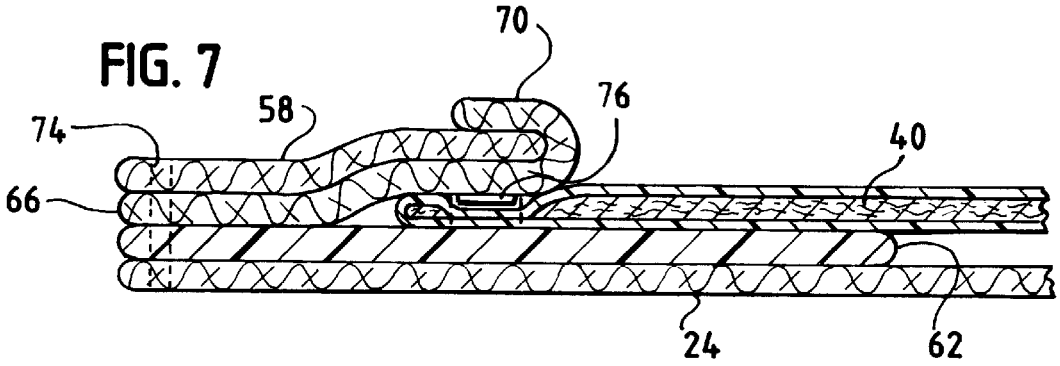
FIG. 7 is a cross sectional view taken along the lines 7—7 in FIG. 5.

A similar view is shown in FIG. 7 illustrating how, in one embodiment of the invention, the inner liner formed of a composite of a moisture barrier and a thermal barrier 40 is attached to the garment. Thus, the composite includes the outer shell 24 and one of the strips 62 overlying the outer shell 24. The second strip 66 of liquid impermeable, wick resistant fabric is positioned above the first strip of liquid impermeable, wick resistant layer 62, including a folded over portion 70 to ensure a continuous liquid-impermeable barrier. The upper layer 58 is the facing material which, as indicated above, can be any one of the outer shell material, moisture barrier fabric or thermal liner fabric. The composite inner liner 40 including both the thermal barrier and the moisture barrier is thus secured by means of fastening means 76 to a corresponding fastening means not illustrated in the drawings for purposes of simplicity. As can be seen from FIG. 7, the leading edge of the composite moisture barrier and thermal barrier extends between the first and second wicking resistant fabrics 62 and 66, respectively, when the inner liner 40 is in position in the garment.

The anti-wicking material employed in the practice of this invention is preferably formed from materials which have the characteristics of impermeability. Suitable materials are material which can likewise be used as moisture barrier, and include such conventional moisture resistant fabrics as Crosstech PJ, Crosstech E89, Breathtex and Breathtex plus. Such materials are commercially available from W. L. Gore and Aldan Rubber Co. It will be observed that the anti-wicking characteristics of the invention thus serve to maximize the protection available to firefighters. At the same time, it does not significantly add to the bulk of the front of the closure of the coat, thus allowing the garment to be donned with a wide frontal opening for a quick response to emergency calls.

It will be understood that various changes and modifications can be made in the details of material, construction, and use without departing from the spirit of the invention, except as defined in the following claims.

What is claimed is:

1. A protective coat for protection against the environment and having improved resistance to toxic liquids including blood borne pathogens comprising:

(a) an outer shell adapted to enclose a torso formed of a heat and flame resistant, moisture resistant and abrasion resistant fabric, said outer shell having plackets attached to be positioned one on the other to close the coat, each of said plackets having an internal facing in the area of the front of the coat whereby each of the facings is displaced toward the other when the plackets of the coat are closed;

(b) a first strip of moisture impermeable, wick resistant material positioned between the outer shell and each of said internal facings;

(c) a second strip of moisture impermeable, wick resistant material underlying each of said internal facings and positioned between the first strip and said internal facing, the second strip extending along each of said internal facings;

(d) a moisture barrier lining formed of a heat resistant, moisture impermeable layer; and (e) a thermal barrier lining formed of a heat resistant, heat insulative layer to provide thermal protection, whereby the moisture barrier, thermal barrier, first and second strips of wick resistant material and internal facings within the outer shell are positioned to provide moisture protection and thermal protection while preventing wicking of liquids through the internal facings to the remainder of the coat, thereby protecting against toxic liquids.

2. A protective coat as defined in claim 1 wherein said internal facings are formed of the outer shell fabric.

3. A protective coat as defined in claim 1 wherein the moisture barrier lining and the thermal barrier lining are formed of a composite material attached to each other.

4. A protective coat as defined in claim 3 wherein each internal facing is formed of a composite moisture barrier and thermal barrier.

5. A protective coat as defined in claim 1 wherein the second strip of moisture impermeable, wick resistant material extends to each of said internal facings by folding over each said facing to overlay a portion thereof.

6. A protective coat as defined in claim 1 wherein at least a portion of each said internal facing is formed from moisture impermeable wick resistant material.

7. A protective coat as defined in claim 1 wherein the pair of first strips of moisture impermeable, wick resistant material are positioned between said internal facings and the outer shell and include a portion integral therewith extending across the coat in the area of the collar.

8. A protective coat as defined in claim 7 which includes a collar flap in the area of the collar of the coat, said collar flap being enclosed by a moisture impermeable, wick resistant fabric resistant to wicking in the area of the collar of the coat.

9. A protective coat as defined in claim 1 wherein each of said internal facings is formed entirely of a moisture resistant, anti-wicking material.

10. A protective garment for protection against the environment and having improved resistance against toxic liquids including blood borne pathogens comprising:

(a) an outer shell adapted to enclose the torso of a wearer, formed of an abrasion resistant fabric, said outer shell having a pair of internal facings in the area of the front of the garment whereby the facings are displaced toward each other when the garment is closed;

(b) a first strip of moisture impermeable, wick resistant material positioned between the outer shell and each of said internal facings;

(c) a second strip of moisture impermeable, wick resistant material underlying each of said internal facings and positioned between the first strips and each of said facings, said second strip extending along each of said facings; and (d) an inner liner formed of at least a moisture barrier whereby the first and second strips of wick resistant material and internal facings within the outer shell are positioned to prevent wicking of liquids through said internal facings to the inner liner and thereby protect against toxic liquids.

11. A protective garment as defined in claim 10 wherein each of said internal facings is formed of the outer shell fabric.

12. A protective garment as defined in claim 10 wherein the inner liner is formed of a composite of moisture barrier material and thermal barrier material attached to each other.

13. A protective garment as defined in claim 12 wherein each of said internal facings is formed of a composite moisture barrier and thermal barrier.

14. A protective garment as defined in claim 10 wherein the second strip of moisture impermeable, wick resistant material extends to each of said internal facings by folding over said facing to overlay a portion thereof.

15. A protective garment as defined in claim 10 wherein at least a portion of each said internal facing is formed from moisture impermeable, wick resistant material.

16. A protective garment as defined in claim 10 wherein the pair of first strips of moisture impermeable, wick resistant material is positioned between said internal facings and the outer shell and includes a portion integral therewith extending across the coat in the area of the collar.

17. A protective garment as defined in claim 16 which includes a collar flap in the area of the collar of the coat, said collar flap being enclosed by a moisture impermeable, wick resistant fabric resistant to wicking in the area of the collar of the coat.

18. A garment as defined in claim 10 wherein the garment is a coat.

19. A garment as defined in claim 10 wherein the garment is a pair of trousers.

20. A protective garment as defined in claim 10 wherein each of said internal facings is formed entirely of a moisture resistant, anti- wicking material.

21. A protective garment as defined in claim 10 wherein the garment is in the form of a coverall.

22. A protective coat for use by a firefighter providing thermal protection against a firefighter environment and having improved resistance to toxic liquids including blood borne pathogens comprising:

(a) an outer shell adapted to enclose a torso formed of a heat and flame resistant, moisture resistant and abrasion resistant fabric, said outer shell having a pair of internal facings in the area of the front of the coat whereby the facings are displaced toward each other when the coat is closed;

(b) a first strip of moisture impermeable, wick resistant material positioned between the outer shell and each of said internal facings;

(c) a second strip of moisture impermeable, wick resistant material underlying each of said internal facings and positioned between the first strip and each of said facings, said second strip extending along each of said facings;

(d) a moisture barrier lining formed of a heat resistant, moisture impermeable layer; and (e) a thermal barrier lining formed of a heat resistant, heat insulative layer to provide thermal protection, whereby the moisture barrier, thermal barrier, first and second strips of wick resistant material and internal facings within the outer shell are positioned to provide moisture protection and thermal protection while preventing wicking of liquids through the internal facings to the remainder of the coat, thereby protecting against toxic liquids.

23. A protective coat as defined in claim 22 wherein each of said internal facings is formed of the outer shell fabric.

24. A protective coat as defined in claim 22 wherein the moisture barrier lining and the thermal barrier lining are attached to each other to form a composite material.

25. A protective coat as defined in claim 24 wherein each of said internal facings is formed of a composite of moisture barrier material and thermal barrier material attached to each other.

26. A protective garment as defined in claim 24 wherein each of said internal facings is formed entirely of a moisture resistant, anti-wicking material.

27. A protective coat as defined in claim 22 wherein the second strip of moisture impermeable, wick resistant material extends to each of said internal facings by folding over said facing to overlay a portion thereof.

* * * * *